US008934651B2

(12) United States Patent
Tokoro et al.

(10) Patent No.: US 8,934,651 B2
(45) Date of Patent: Jan. 13, 2015

(54) SOUND IMAGE LOCALIZATION DEVICE

(75) Inventors: Yukinobu Tokoro, Osaka (JP); Masanori Harui, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 295 days.

(21) Appl. No.: 13/611,564

(22) Filed: Sep. 12, 2012

(65) Prior Publication Data

US 2013/0243226 A1 Sep. 19, 2013

(30) Foreign Application Priority Data

Mar. 16, 2012 (JP) ..... 2012-059775

(51) Int. Cl.
*H04R 5/02* (2006.01)

(52) U.S. Cl.
USPC ..... 381/309

(58) Field of Classification Search
None
See application file for complete search history.

(56) References Cited

U.S. PATENT DOCUMENTS

| | | | | |
|---|---|---|---|---|
| 8,270,616 | B2 * | 9/2012 | Slamka et al. | 381/17 |
| 2002/0019892 | A1 * | 2/2002 | Kondo et al. | 710/62 |
| 2007/0092085 | A1 * | 4/2007 | Katayama et al. | 381/17 |
| 2008/0219454 | A1 * | 9/2008 | Iida et al. | 381/17 |

FOREIGN PATENT DOCUMENTS

| | | | | |
|---|---|---|---|---|
| JP | 2003-153398 | A | 3/2003 | |
| JP | 2003153398 | A * | 5/2003 | H04S 1/00 |

OTHER PUBLICATIONS

Bogen, PEQ1R Parametric Equalizer Output Module, 2001, Bogen Communications, Inc.*

* cited by examiner

*Primary Examiner* — Wayne Young
*Assistant Examiner* — Mark Fischer
(74) *Attorney, Agent, or Firm* — Renner, Otto, Boisselle & Sklar, LLP

(57) ABSTRACT

A sound image localization device is provided, by which a user can easily adapt out-of-head sound image localization to oneself. A filter is configured to perform, for an input signal(s), filtering using a filter coefficient output from a parametric HRTF generator and generate an output signal(s) for the headphone. A user adjuster is capable of invalidating a notch N2 of a parametric HRTF. When the notch N2 is invalidated, a parametric HRTF without the notch N2 is generated in the filter.

7 Claims, 8 Drawing Sheets

SOUND IMAGE LOCALIZATION DEVICE

CROSS-REFERENCE TO RELATED APPLICATION

This application claims priority to Japanese Patent Application No. 2012-059775 filed on Mar. 16, 2012, the disclosure of which including the specification, the drawings, and the claims is hereby incorporated by reference in its entirety.

BACKGROUND

The instant application relates to a sound image localization device capable of out-of-head sound image localization which is performed by listening to sound with a headphone and which is adaptable to different individuals.

In the out-of-head sound image localization performed by listening to sound with the headphone, a head-related transfer function (HRTF) for a listener varies among different individuals. A method for adapting the out-of-head sound image localization to different individuals includes, e.g., a method using a parametric HRTF approach in which an HRTF simply represents frequency peak characteristics and frequency notch characteristics of a monaural spectrum influencing the localization. Such a method has been used for virtual sound image processing including the out-of-head sound image localization. For example, a method has been employed, in which out-of-head sound image localization is performed by using a parametric HRTF having a single peak and two notches (see, e.g., Japanese Patent Publication No. 2003-153398).

SUMMARY

In the foregoing method, in order to adapt the parametric HRTF to different listeners, each listener is required to determine optimal values for the single peak and the two notches. Suppose that the number of searches is represented by L×M×N where the number of patterns of a peak frequency is represented by "L" and the number of patterns of a notch frequency is represented by "M" and "N." In order to search three variable parameters, the large number of searches are required.

The instant application describes a sound image localization device in which adaptation of out-of-head sound image localization to different users is facilitated.

In one general aspect, the instant application describes a sound image localization device for performing out-of-head sound image localization by listening to sound with a headphone. The sound image localization device includes a user adjuster configured such that a user can adjust frequencies at N notches of a parametric HRTF, N being an integer of 2 or more; a parametric HRTF generator configured to output a filter coefficient for realizing the parametric HRTF based on the frequencies at the N notches adjusted by the user adjuster; and a filter configured to perform, for an input signal, filtering using the filter coefficient output from the parametric HRTF generator and generate an output signal for the headphone. The user adjuster is capable of invalidating at least one of the N notches. When a first notch of the at least one of the N notches is invalidated by the user adjuster, at least one of the parametric HRTF generator and the filter is capable of realizing a parametric HRTF without the first notch.

According to the foregoing aspect, the user adjuster is capable of invalidating at least one of the N notches of the parametric HRTF. When the first notch is invalidated, the parametric HRTF without the first notch can be generated.

Thus, since the user can adjust the frequency at other notch in the state in which the first notch is invalidated, the number of combinations of the notch frequencies for which searches are required to be made in order to adapt the out-of-head sound image localization to different individuals is significantly reduced. Since the number of searches required for the adaptation of the out-of-head sound image localization to different individuals can be significantly reduced, the user can easily adapt the out-of-head sound image localization to oneself.

In the foregoing aspect, the sound image localization device may be configured without the user adjuster, or may be configured as software.

According to the sound image localization device of the instant application, the number of searches required for the adaptation of the out-of-head sound image localization to different individuals can be significantly reduced, the user can easily adapt the out-of-head sound image localization to oneself.

DETAILED DESCRIPTION

Embodiments are described in detail below with reference to the attached drawings. However, unnecessarily detailed description may be omitted. For example, detailed description of well known techniques or description of the substantially same elements may be omitted. Such omission is intended to prevent the following description from being unnecessarily redundant and to help those skilled in the art easily understand it.

Inventors provide the following description and the attached drawings to enable those skilled in the art to fully understand the present disclosure. Thus, the description and the drawings are not intended to limit the scope of the subject matter defined in the claims.

In the following embodiments, a frequency at a peak P1 which does not significantly change depending on individuals is fixed to, e.g., 4 kHz, and high frequencies (around 5-13 kHz) at notches N1, N2 which vary among individuals are adjusted by a user. The peak P1 and the adjusted notches N1, N2 are used to compose a parametric HRTF which is a simple HRTF recomposed from a measured HRTF, thereby adapting out-of-head sound image localization to different individuals.

First Embodiment

Figure 1:
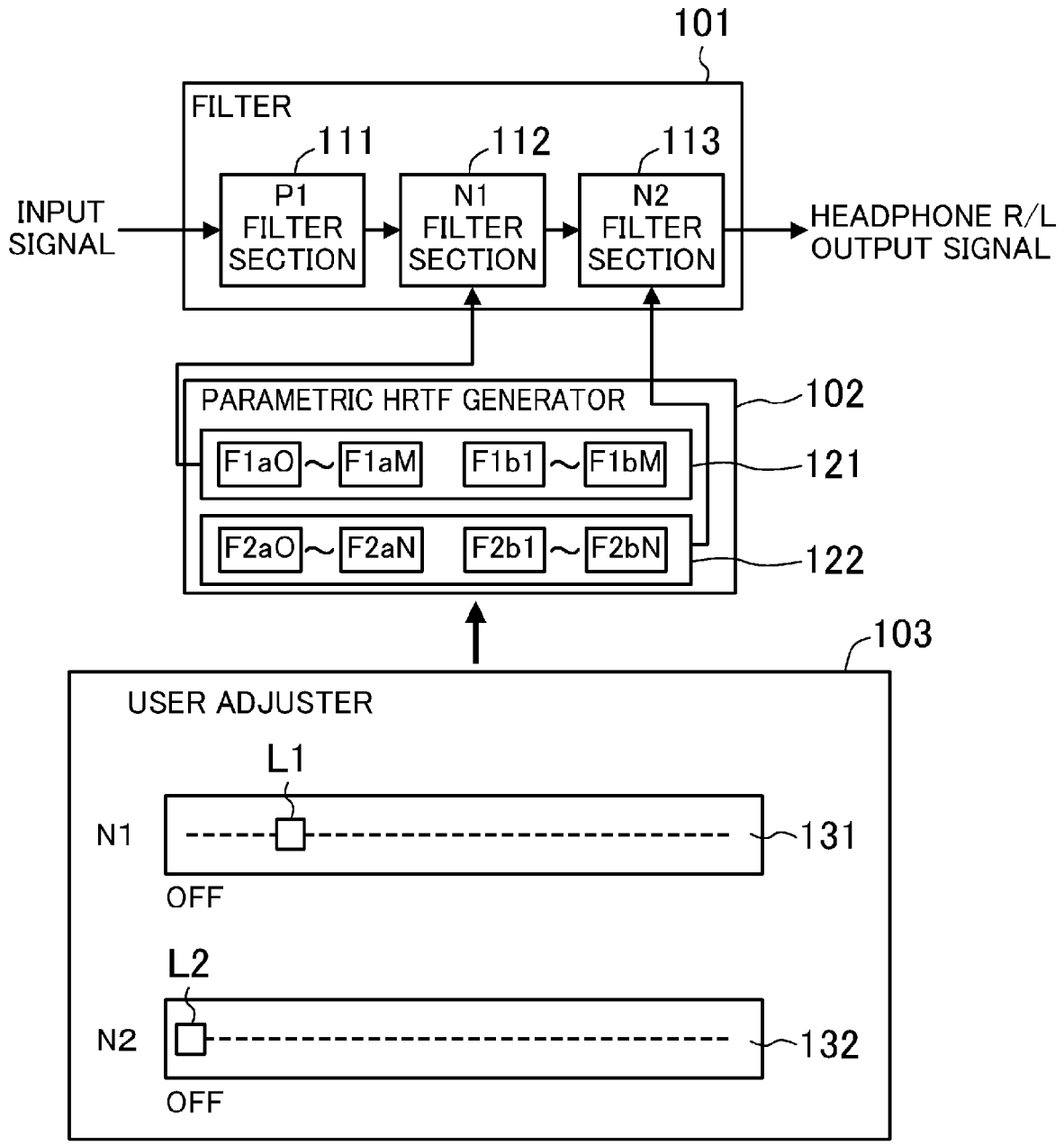
FIG. 1 is a diagram illustrating a configuration of a sound image localization device of a first embodiment.

FIG. 1 is a diagram illustrating a configuration of a sound image localization device of the present embodiment. In FIG. 1, a reference numeral "101" represents a filter configured to generate, after out-of-head sound image localization, a headphone output signal(s) from an input signal(s), a reference numeral "102" represents a parametric HRTF generator configured to generate a parametric HRTF for the out-of-head sound image localization, and a reference numeral "103" represents a user adjuster configured to adjust, as necessary, a notch frequency of the parametric HRTF by a user.

Figure 2:
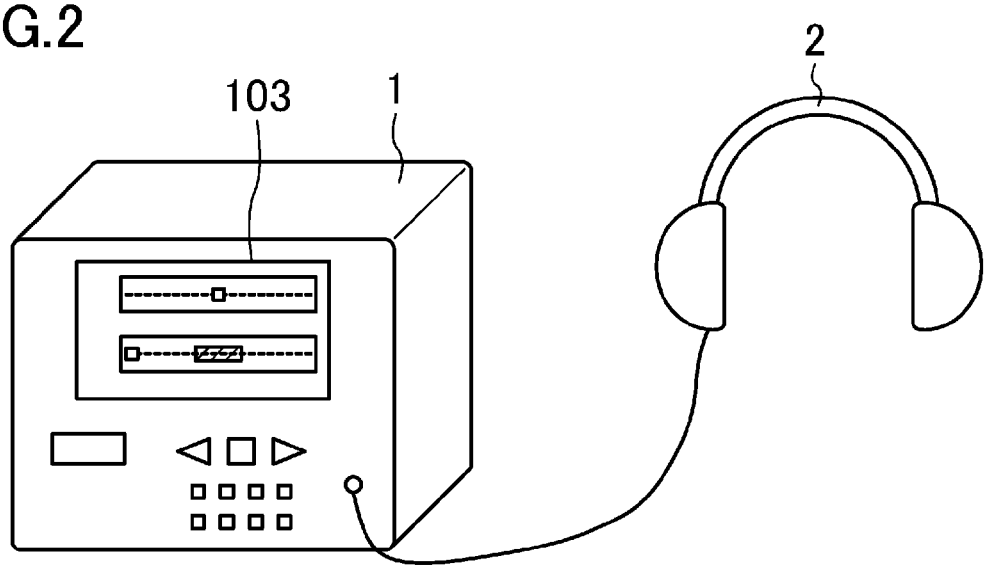
FIG. 2 is a conceptual diagram of a specific apparatus in which the sound image localization device is mounted.

FIG. 2 is a conceptual diagram illustrating a specific example of an apparatus in which the sound image localization device is mounted. In a configuration illustrated in FIG. 2, a headphone 2 is connected to an audio reproduction device 1. The filter 101 and the parametric HRTF generator 102 illustrated in FIG. 1 are built in the audio reproduction device 1, and the user adjuster 103 is configured as a touch panel for an operation.

Figure 3:
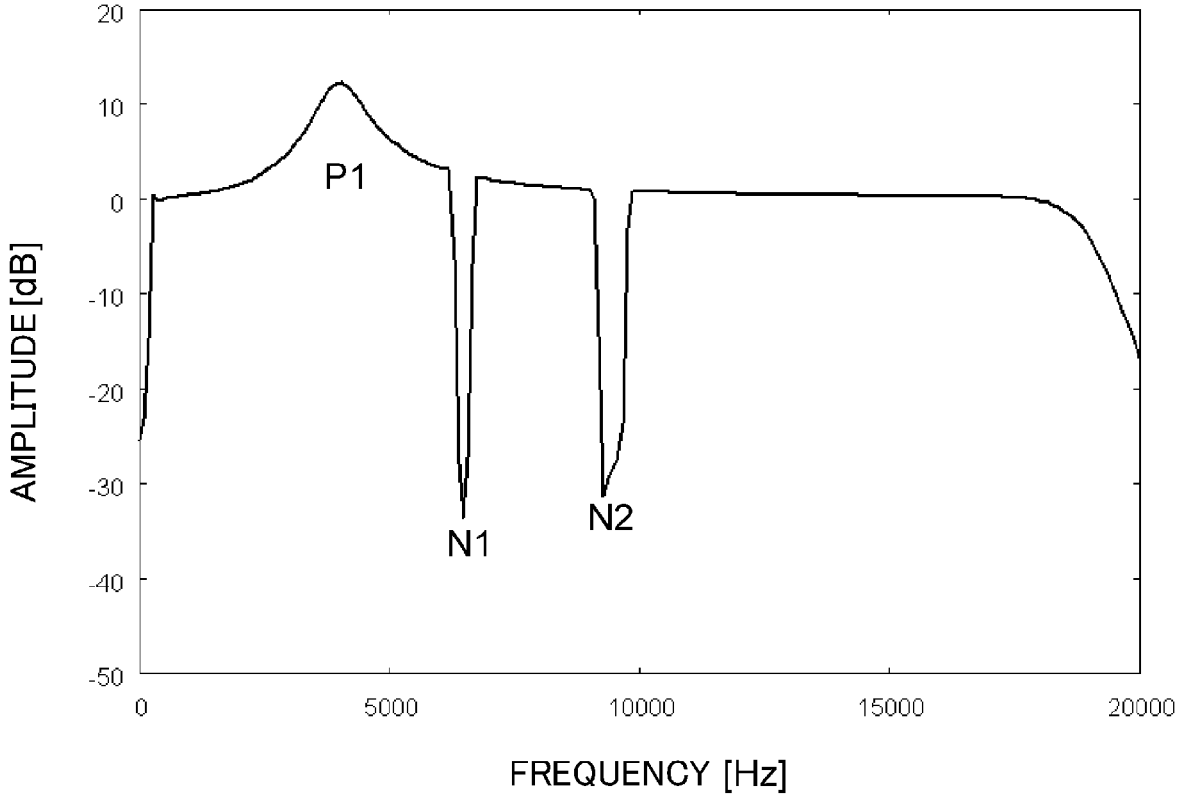
FIG. 3 is a graph illustrating an example of a parametric HRTF composed of a peak P1 and notches N1, N2.

FIG. 3 is a graph illustrating an example of the parametric HRTF composed of the peak P1 and the notches N1, N2. The vertical axis represents an amplitude, and the horizontal axis represents a frequency.

Referring back to FIG. 1, the user adjuster 103 includes a first setter 131 configured to adjust a center frequency at the notch N1, and a second setter 132 configured to adjust a center frequency at the notch N2. The first setter 131 and the second setter 132 include levers L1, L2 configured to adjust a frequency, respectively. Each of the first setter 131 and the second setter 132 is capable of invalidating a corresponding one of the notches N1, N2. That is, the notch N1, N2 is invalidated by moving the lever L1, L2 to a position indicated by "OFF." For example, when the notch N1 is invalidated, the filter 101 and the parametric HRTF generator 102 generate a parametric HRTF without the notch N1. When the notch N2 is invalidated, a parametric HRTF without the notch N2 is generated.

In the filter 101, a P1 filter section 111 configured to generate the peak P1, an N1 filter section 112 configured to generate the notch N1, and an N2 filter section 113 configured to generate the notch N2 are arranged in column. Each of the filter sections 111, 112, 113 is an infinite impulse response (IIR) filter, but the instant application is not limited to such a filter. For the P1 filter section 111, a filter coefficient for realizing a center frequency of 4 kHz at the peak P1 is set in advance. On the other hand, for each of the N1 filter section 112 and the N2 filter section 113, a filter coefficient output from the parametric HRTF generator 102 is set. An input signal(s) is filtered by the P1 filter section 111, the N1 filter section 112, and the N2 filter section 113, thereby generating a headphone output signal(s) for which the out-of-head sound image localization is performed.

The parametric HRTF generator 102 outputs a filter coefficient for realizing the parametric HRTF based on the frequencies at the notches N1, N2 adjusted by the user adjuster 103. The parametric HRTF generator 102 includes a first storage 121 configured to store filter coefficients F1*a*0-F1*a*M, F1*b*1-F1*b*M which are set for the N1 filter section 112, and a second storage 122 configured to store filter coefficients F2*a*0-F2*a*N, F2*b*1-F2*b*N which are set for the N2 filter section 113 (each of "M" and "N" is an integer of 2 or more). The parametric HRTF generator 102 sets, for the N1 filter section 112, any of the filter coefficients stored in the first storage 121 based on the adjusted frequency at the notch N1, and sets, for the N2 filter section 113, any of the filter coefficients stored in the second storage 122 based on the adjusted frequency at the notch N2.

Of the filter coefficients stored in the first storage 121, the filter coefficients F1*a*1-F1*a*M are used in the case where the notch N2 is valid, and the filter coefficients F1*b*1-F1*b*M are used in the case where the notch N2 is invalid. Of the filter coefficients stored in the second storage 122, the filter coefficients F2*a*1-F2*a*N are used in the case where the notch N1 is valid, and the filter coefficients F2*b*1-F2*b*N are used in the case where the notch N1 is invalid. That is, as will be described later, in the present embodiment, the shape of one of the notches N1, N2 is different between the case where the other one of the notches N1, N2 is valid and the case where the other one of the notches N1, N2 is invalid. The filter coefficients F1*a*0, F2*a*0 are used in the case where the notches N1, N2 are invalidated.

Figure 4:
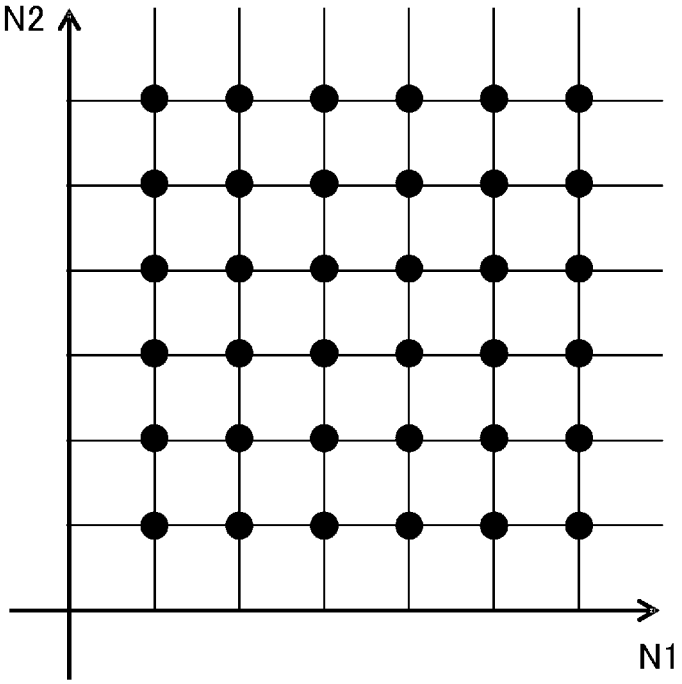
FIG. 4 is a graph illustrating an arrangement example of frequencies at the notches N1, N2.

FIG. 4 is a graph illustrating an arrangement example of the center frequencies at the notches N1, N2. The horizontal axis represents a frequency at the notch N1, and the vertical axis represents a frequency at the notch N2. Each black circle represents a settable combination of frequencies at the notches N1, N2, and settable center frequencies are discretely arranged. In the user adjuster 103, the center frequencies illustrated in FIG. 4 are settable. In the parametric HRTF generator 102, the filter coefficients corresponding to the center frequencies illustrated in FIG. 4 are stored.

Suppose that the number of patterns of the center frequency at the notch N1 is represented by "M," and the number of patterns of the center frequency at the notch N2 is represented by "N." In order to search all combinations for adapting the out-of-head sound image localization to different individuals, the number of required searches is (M×N). Since the configuration in which the notch can be invalidated is employed in the present embodiment, e.g., the following steps may be taken: invalidating the notch N2; searching an optimal frequency at the notch N1; and searching an optimal frequency at the notch N2 in the state in which the frequency at the notch N1 is set to the optimal frequency. This reduces the number of required searches to (M+N).

A method for adapting the out-of-head sound image localization to different individuals by using the sound image localization device illustrated in FIG. 1 will be described. White noise is added to the filter 101 as an input signal(s). Then, a user adjusts the notches N1, N2 while listening output from the headphone.

The user first sets the lever L2 of the second setter 132 of the user adjuster 103 to the position indicated by "OFF" to invalidate the notch N2. At this point, the filter coefficient F2*a*0 for invalidation is set for the N2 filter section 113. In such a state, the user moves the lever L1 of the first setter 131 while listening output from the headphone, and adjusts the frequency at the notch N1. Then, the user sets the lever L1 at the best position where the user can sense the out-of-head sound image localization in front of the user's forehead. In the foregoing operation, any of the filter coefficients F1*b*1-F1*b*M used in the case where the notch N2 is invalidated is set for the N1 filter section 112.

Figure 5:
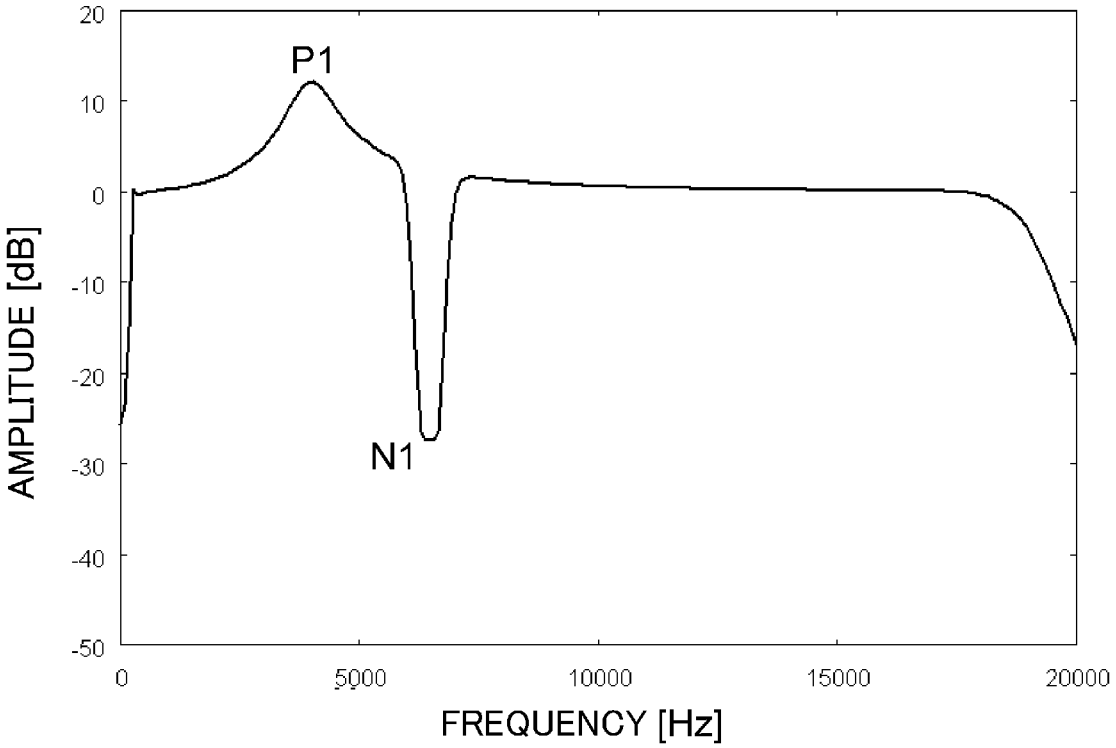
FIG. 5 is a graph illustrating an example of the parametric HRTF when the notch N2 is invalidated.

FIG. 5 illustrates an example of the parametric HRTF in the case where the notch N2 is invalidated. As will be seen from a comparison between FIGS. 3 and 5, the width of the notch N1 is increased. That is, in the present embodiment, if one of the notches is invalidated, a Q factor for the notch to be adjusted is decreased, thereby increasing the width of the notch.

Figure 6:
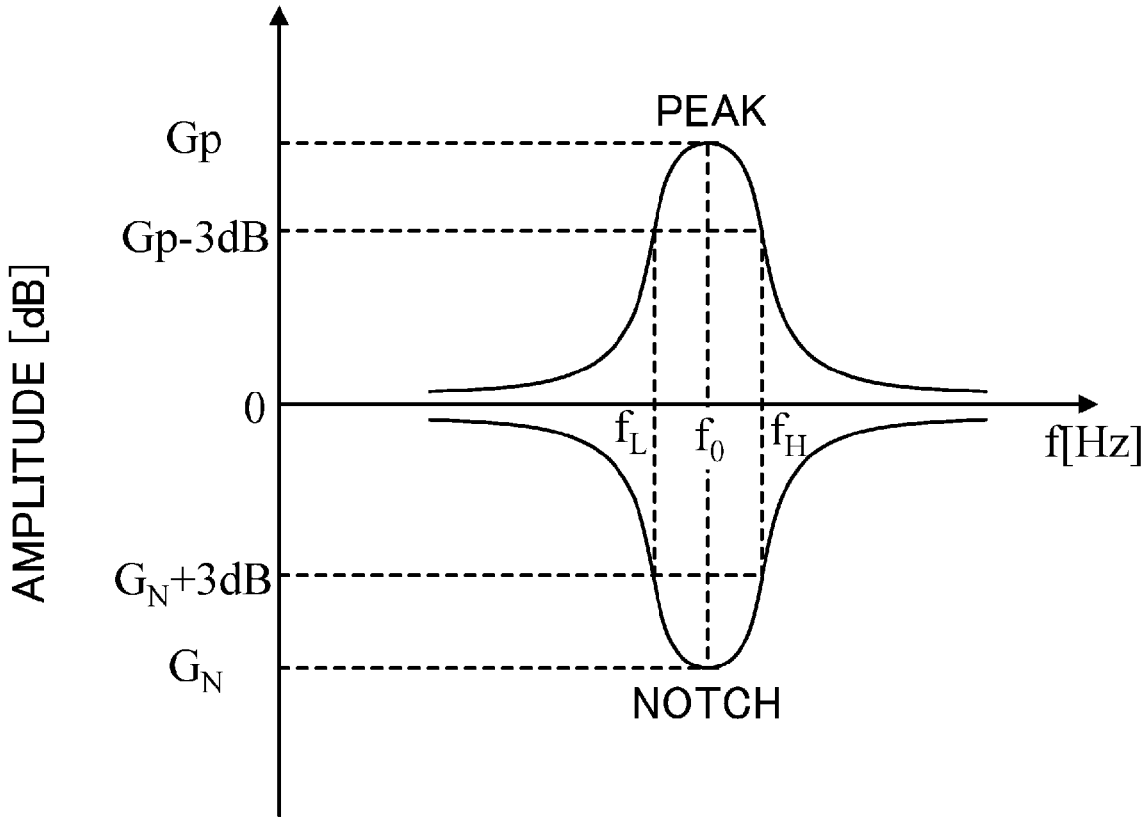
FIG. 6 is a graph for describing a Q factor.

FIG. 6 is a graph for describing the Q factor. The vertical axis represents an amplitude, and the horizontal axis represents a frequency. The Q factor is represented by the following expression:

$$Q\ \text{Factor} = \frac{f_0}{f_H - f_L}$$

where "$f_0$" is a center frequency at a peak/notch, and "$f_L$" and "$f_H$" is frequencies at each of which an amplification/attenuation amount relative to an amplitude for the center frequency $f_0$ is 3 dB.

If one of the notches N1, N2 is invalidated, a user's sense of the out-of-head sound image localization is typically weakened, and there is a possibility that selection of an optimal notch frequency is difficult. In the present embodiment, if one of the notches is invalidated and only one notch remains, the Q factor for the remaining notch is decreased to increase the width of the remaining notch referring to FIG. 5. This reduces the weakening of the user's sense of the out-of-head sound image localization, and therefore the user can easily search the optimal notch frequency.

The weakening of the user's sense of the out-of-head sound image localization can be reduced by decreasing the Q factor for the notch to be adjusted. Experimental results obtained by the present inventors show that, if one of the notches is invalidated, it is more effective to set the Q factor to, e.g., equal to or less than the half of a Q factor in the case where both notches are valid.

When the frequency at the notch N1 can be set to the optimal frequency, the user validates the notch N2 to adjust the frequency at the notch N2. At this point, for the N1 filter section 112, any of the filter coefficients F1*a*1-F1*a*M used in the case where the notch N2 is validated. Then, the user moves the lever L2 of the first setter 131 while listening output from the headphone, and adjusts the frequency at the notch N2. Subsequently, the user sets the lever L2 at the best position where the user can sense the out-of-head sound image localization in front of the user's forehead. In the foregoing operation, any of the filter coefficients F2*a*1-F2*a*N used in the case where the notch N1 is validated is set for the N2 filter section 113.

Needless to say, the notch N1 may be first invalidated, and then the frequency at the notch N2 may be adjusted. Subsequently, the frequency at the notch N1 may be adjusted.

Figure 7:
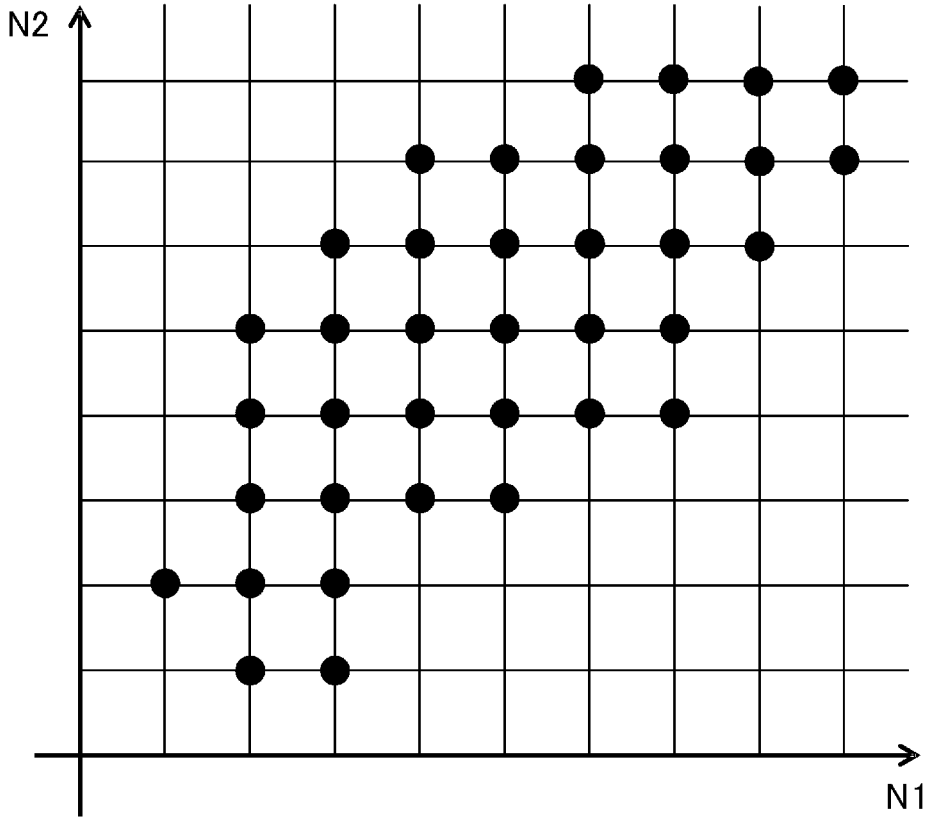
FIG. 7 is a graph illustrating another arrangement example of the frequencies at the notches N1, N2.
Figure 8:
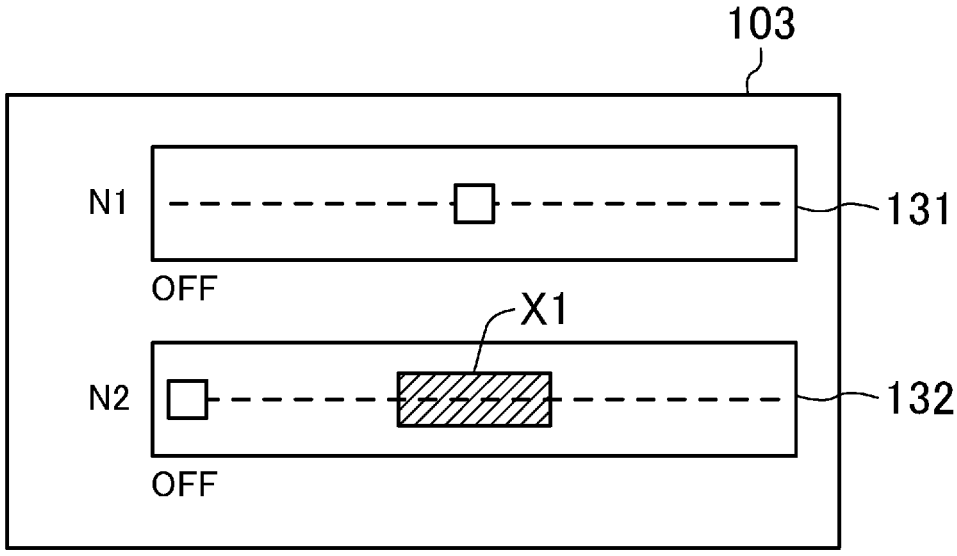
FIG. 8 is a diagram illustrating an example where an input limitation is set in a user adjuster.

FIG. 7 illustrates another arrangement example of the center frequencies at the notches N1, N2. In FIG. 4, all combinations of the center frequencies at the notches N1, N2 are settable. However, in FIG. 7, a certain limitation is put on the center frequency at one of the notches. The settable combinations of the center frequencies at the notches may be limited as described above. In such a case, referring to, e.g., FIG. 8, an adjustable range X1 for one of the notches (notch N2 in FIG. 8) may be displayed depending on setting of the other notch (notch N1 in FIG. 8) in the user adjuster 103. Alternatively, a certain limitation may be put on an adjustable range of the lever L1, L2.

When one of the notches is invalidated, the width of the other notch is not necessarily changed. In such a case, the filter coefficients F1*b*1-F1*b*M, F2*b*1-F2*b*N are not necessary.

Second Embodiment

In the present embodiment, a parametric HRTF is separately determined for each of a right output (hereinafter referred to as an "R-output") and a left output (hereinafter referred to as a "L-output") of a headphone. Although there is a possibility that optimal notch frequencies sensed by right and left ears are different from each other, a user's sense of out-of-head sound image localization can be enhanced in the present embodiment.

Figure 9:
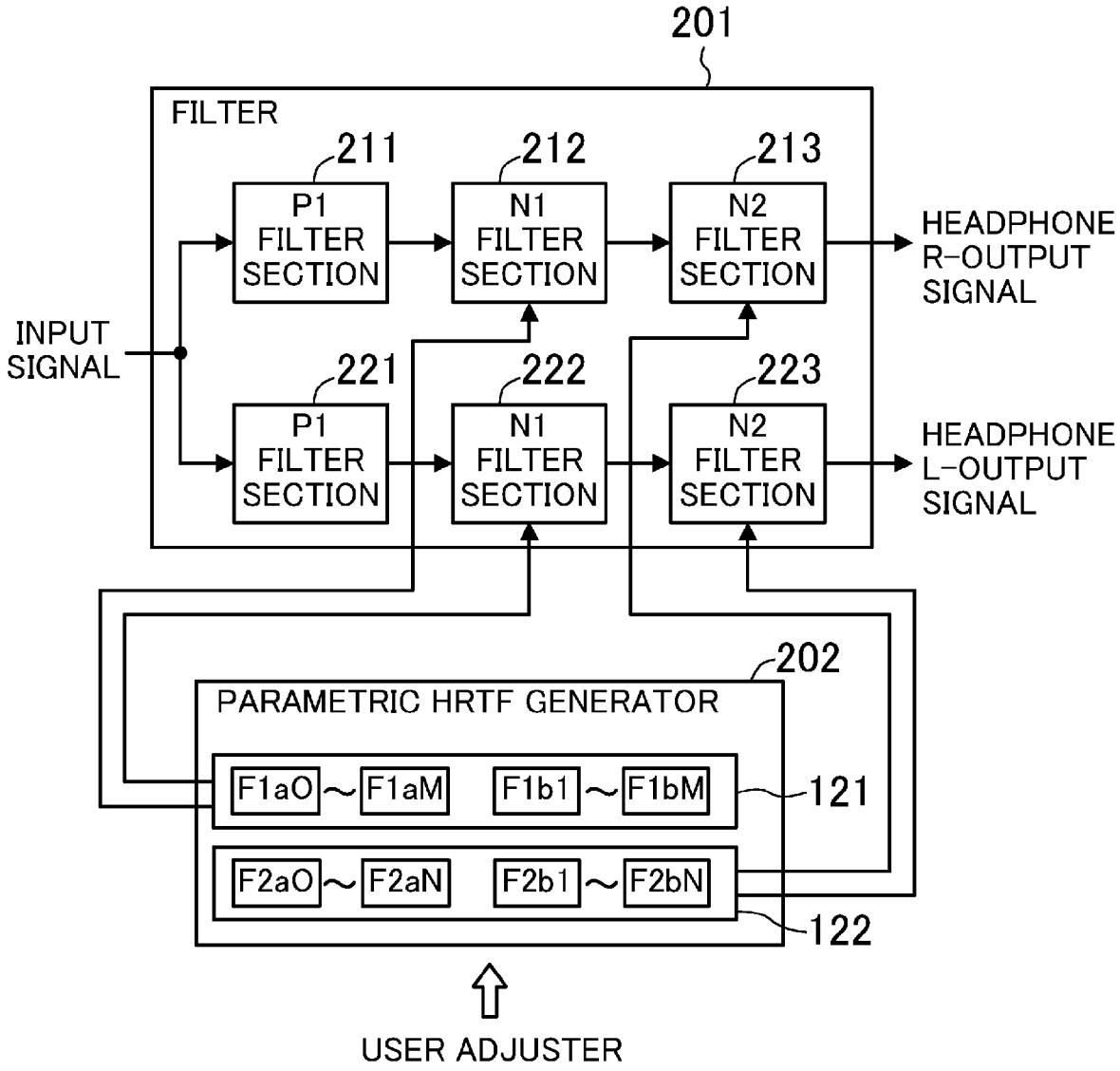
FIG. 9 is a diagram illustrating a configuration of a sound image localization device of a second embodiment.

FIG. 9 is a diagram illustrating a configuration of a sound image localization device of the present embodiment. In FIG. 9, a reference numeral "201" represents a filter configured to generate, after the out-of-head sound image localization, a headphone output signal(s) from an input signal(s), and a reference numeral "202" represents a parametric HRTF generator configured to generate a parametric HRTF for the out-of-head sound image localization. A user adjuster is not shown in the figure.

The filter 201 individually performs filtering for each of the R-output and the L-output of the headphone. For the filtering of the R-output, a P1 filter section 211 configured to generate a peak P1, an N1 filter section 212 configured to generate a notch N1, and an N2 filter section 213 configured to generate a notch N2 are arranged in column. For the filtering of the L-output, a P1 filter section 221 configured to generate a peak P1, an N1 filter section 222 configured to generate a notch N1, and an N2 filter section 223 configured to generate a notch N2 are arranged in column. Each of the filter sections 211, 212, 213, 221, 222, 223 is an IIR, but the instant application is not limited to such a filter. For each of the P1 filter sections 211, 221, a filter coefficient for realizing a center frequency of 4 kHz at the peak P1 is set in advance. On the other hand, for each of the N1 filter sections 212, 222 and the N2 filter sections 213, 223, a filter coefficient output from the parametric HRTF generator 202 is set.

The parametric HRTF generator 202 outputs a filter coefficient for realizing the parametric HRTF based on frequencies at the notches N1, N2 adjusted by the user adjuster. The parametric HRTF generator 202 includes a first storage 121 and a second storage 122 each configured to store the filter coefficients similar to those illustrated in FIG. 1. Upon adjustment of the R-output, the parametric HRTF generator 202 sets, for the N1 filter section 212, any of the filter coefficients stored in the first storage 121 based on the adjusted frequency at the notch N1, and sets, for the N2 filter section 213, any of the filter coefficients stored in the second storage 122 based on the adjusted frequency at the notch N2. Similarly, upon adjustment of the L-output, the parametric HRTF generator 202 sets, for the N1 filter section 222, any of the filter coefficients stored in the first storage 121 based on the adjusted frequency at the notch N1, and sets, for the N2 filter section 223, any of the filter coefficients stored in the second storage 122 based on the adjusted frequency at the notch N2.

The filter coefficients are shared for the R-output and the L-output as described above, but filter coefficients may be determined separately for each of the R-output and the L-output.

A method for adapting the out-of-head sound image localization to different individuals by using the sound image localization device illustrated in FIG. 9 will be described. White noise is added to the filter 201 as an input signal(s). Then, a user adjusts the notches N1, N2 while listening output from the headphone.

Figure 10A:
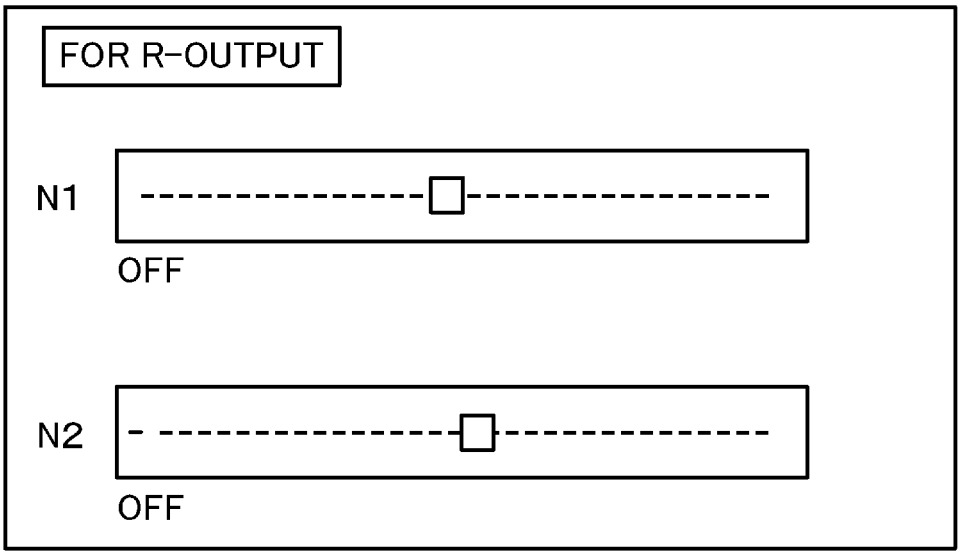
FIGS. 10A and 10B are diagrams illustrating an example of a user adjuster of the second embodiment.

As in the first embodiment, the user first makes adjustment while operating, e.g., a user adjuster for the R-output as illustrated in FIG. 10A. At this point, the same parametric HRTF is set for both of the R-output and the L-output. That is, the adjustment is made such that the frequencies are optimal in the case where the same parametric HRTF is used for the R-output and the L-output. Needless to say, the user may operate a user adjuster for the L-output.

Figure 10B:
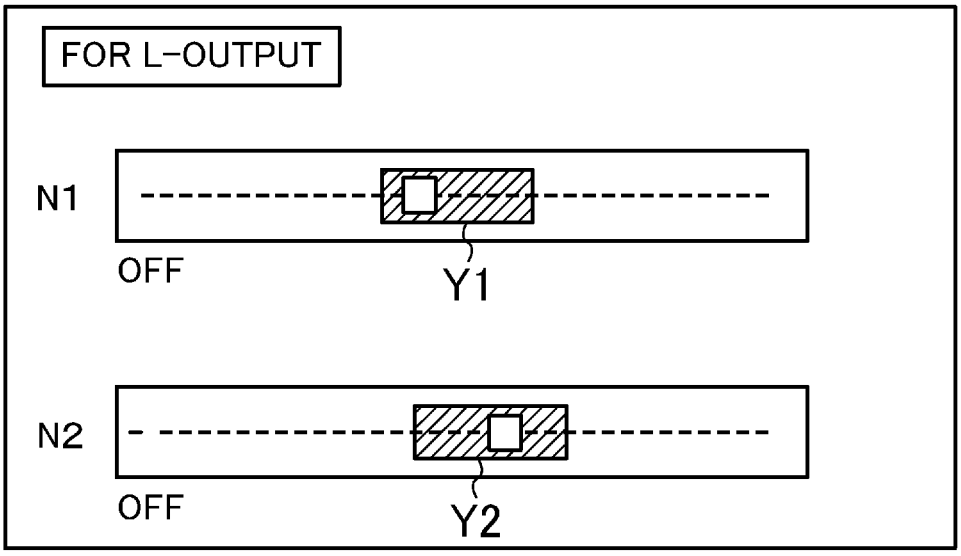

Next, the user operates, as in the first embodiment, the user adjuster illustrated in FIG. 10B to adjust the L-output. At this point, the parametric HRTF for the R-output is fixed to a state adjusted as illustrated in FIG. 10A, and the user adjusts the parametric HRTF for the L-output. In such a state, in the user adjuster, a range (range Y1, Y2 in FIG. 10B) near each of the notch frequencies fixed for the R-output is marked so that the user can recognize such a range. This facilitates the adjustment by the user. Subsequently, the user adjusts the R-output in the state in which the parametric HRTF for the adjusted L-output is fixed. In such a state, in the user adjuster, a range near each of the notch frequencies fixed for the L-output may be marked so that the user can recognize such a range. Note that the R-output may be first adjusted, and then L-output may be adjusted.

The user adjuster illustrated in FIGS. 10A and 10B may be configured such that an operator is separately provided for each of the R-output and the L-output, or may be configured such that the same operator is used to switch a screen display between the R-output and the L-output.

Other Embodiment

As described above, the first and second embodiments have been described as example techniques disclosed in the instant application. However, the techniques according to the present disclosure are not limited to these embodiments, but are also applicable to those where modifications, substitutions, additions, and omissions are made. In addition, elements described in the first and second embodiments may be combined to provide a different embodiment.

Other embodiment will be described below as an example.

In the foregoing embodiments, the two notches N1, N2 are used for the parametric HRTF. However, the instant application is not limited to such a configuration, and three or more notches may be used. For example, a notch N3 is set in a higher frequency range than those of the notches N1, N2, thereby enhancing the user's sense of the out-of-head sound image localization. In addition, both of the two notches N1, N2 can be invalidated, but one of the notches N1, N2 may be invalidated. That is, if at least one of N notches ("N" is an integer of 2 or more) can be invalidated, the number of searches for the frequency adjustment can be reduced.

In the foregoing embodiments, the notch is invalidated by setting the filter coefficient. However, the method for invalidating the notch is not limited to such a method. For example, the filter 101 illustrated in FIG. 1 may be configured such that a signal path bypassing the N1 filter section 112 is separately provided, and that the filter 101 switches a selector between the state in which the N1 filter section 112 is bypassed and the state in which the N1 filter section 112 is not bypassed. When the user adjuster 103 sets the notch N1 to "OFF," the filter 101 switches the selector to the state in which an input signal(s) bypasses the N1 filter section 112. The same applies to the notch N2. In such a case, in the parametric HRTF generator 102, the filter coefficients F1*a*0, F2*a*0 are not necessary.

In the foregoing embodiments, the frequency at the peak P1 is fixed, and the HRTF around the peak P1 is generated by the filter. However, the instant application is not limited to such a configuration. For example, any measured HRTF may be used for a frequency band of equal to or less than 5 kHz including the peak P1 which is less likely to vary among individuals. Alternatively, a user may adjust the peak P1.

In the foregoing embodiments, the center frequencies at the notches N1, N2 are adjusted. However, the instant application is not limited to such a configuration. For example, a certain frequency range may be specified in order to adjust the notch frequency.

The parametric HRTF adaptable to different individuals is generated only for the localization in front of the user's forehead. If it is necessary to generate a parametric HRTF for localization in a direction other than the front of the user's forehead, the parametric HRTF may be generated by a method for estimating a parametric HRTF based on the parametric HRTF which is for the localization in front of the user's forehead and which is adaptable to different individuals, as described at pages 174-176 of a document (Principles and Applications of Spatial Hearing, Miyagi-Zao Royal Hotel, Zao, Japan, Nov. 11-13, 2009, World Scientific Publishing Co. Pte. Ltd.).

Figure 11:
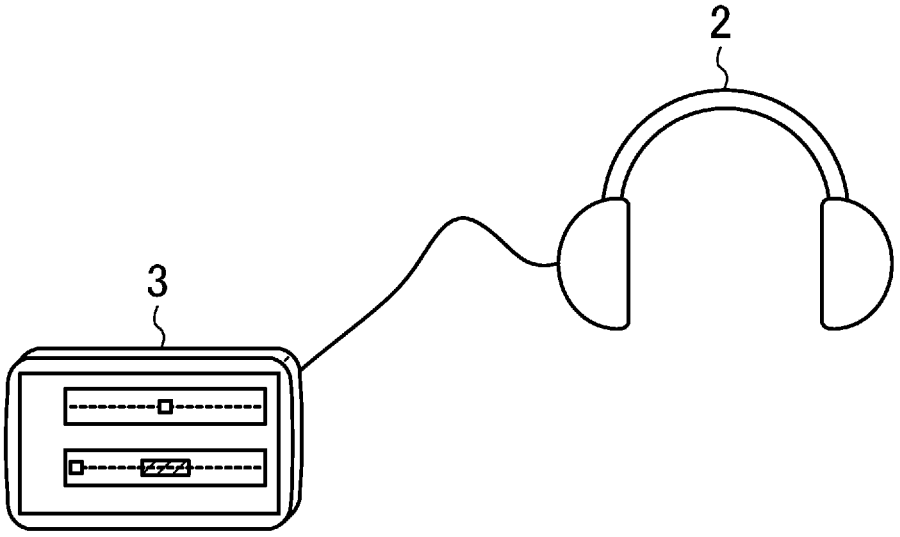
FIG. 11 is a conceptual diagram of a specific apparatus in which the sound image localization device is mounted.
Figure 12:
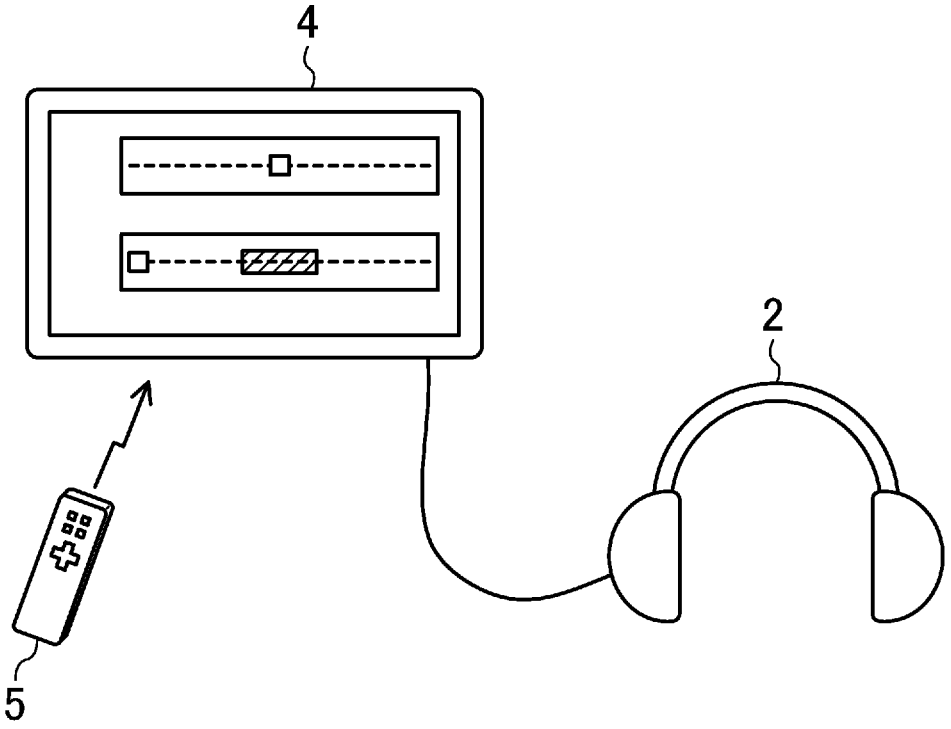
FIG. 12 is a conceptual diagram of a specific apparatus in which the sound image localization device is mounted.

FIGS. 11 and 12 are conceptual diagrams illustrating other specific examples of the apparatus in which the sound image localization device is mounted. In a configuration illustrated in FIG. 11, a headphone 2 is connected to a smartphone 3. A filter and a parametric HRTF generator are built in the smartphone 3, and a user adjuster is configured as a touch panel for an operation of the smartphone 3. In a configuration illustrated in FIG. 12, a headphone 2 is connected to a television set 4. A filter and a parametric HRTF generator are built in the television set 4, and a function of a user adjuster is realized by operating a screen of the television set 4 with a remote controller 5.

Part or all of functions of the filter and the parametric HRTF generator can be realized by software. The filter may be built in the headphone itself. Alternatively, the filter and the parametric HRTF generator may be built in the headphone itself, or the user adjuster may be built in the headphone itself.

That is, the sound image localization device for performing the out-of-head sound image localization by listening to sound with the headphone may include the parametric HRTF generator configured to output the filter coefficient for realizing the parametric HRTF based on the frequencies at the externally-given N notches (N is an integer of 2 or more); and the filter configured to perform, for an input signal, the filtering using the filter coefficient output from the parametric HRTF generator and generate an output signal for the headphone. At least one of the parametric HRTF generator and the filter may be, when receiving a command to invalid a first notch of the N notches, capable of realizing the parametric HRTF without the first notch.

Alternatively, a program for performing the out-of-head sound image localization by listening to sound with the headphone may cause a computer to generate the filter coefficient for realizing the parametric HRTF based on the frequencies at the given N notches (N is an integer of 2 or more), and to perform, for an input signal, the filtering using the filter coefficient and execute processing for generating an output signal for the headphone. When the first notch of the N notches is invalidated, the program may be capable of realizing the parametric HRTF without the first notch.

Various embodiments have been described above as example techniques of the present disclosure, in which the attached drawings and the detailed description are provided.

As such, elements illustrated in the attached drawings or the detailed description may include not only essential elements for solving the problem, but also non-essential elements for solving the problem in order to illustrate such techniques. Thus, the mere fact that those non-essential elements are shown in the attached drawings or the detailed description should not be interpreted as requiring that such elements be essential.

Since the embodiments described above are intended to illustrate the techniques in the present disclosure, it is intended by the following claims to claim any and all modifications, substitutions, additions, and omissions that fall within the proper scope of the claims appropriately interpreted in accordance with the doctrine of equivalents and other applicable judicial doctrines.

According to the instant application, the out-of-head sound image localization performed by listening to sound with the headphone can be easily adapted to different individuals. Thus, it is useful to improve the quality of a sound output from, e.g., a television set or a smartphone.

What is claimed is:

1. A sound image localization device for performing out-of-head sound image localization of sound being listened to by a user through a headphone, the sound image localization device comprising:

a user adjuster configured such that the user can adjust frequencies at N notches of a parametric head-related transfer function (HRTF), N being an integer of 2 or more;

a parametric HRTF generator configured to output a filter coefficient for realizing the parametric HRTF based on the frequencies at the N notches adjusted by the user adjuster; and a filter configured to perform, for an input signal, filtering using the filter coefficient output from the parametric HRTF generator and generate an output signal for the headphone, wherein the user adjuster is capable of invalidating at least one of the N notches, and when a first notch of the at least one of the N notches is invalidated by the user adjuster, at least one of the parametric HRTF generator and the filter is capable of realizing a parametric HRTF without the first notch, and if the first notch is invalidated, the parametric HRTF generator outputs a filter coefficient for reducing a Q factor for another notch as compared to a Q factor when the first notch is valid.

2. The sound image localization device of claim 1, wherein the filter includes a plurality of filter sections corresponding respectively to the N notches, and when the first notch is invalidated, the parametric HRTF generator outputs a filter coefficient for invalidating a filtering function of a filter section corresponding to the first notch.

3. The sound image localization device of claim 1, wherein when the first notch is invalidated, the parametric HRTF generator outputs a filter coefficient for reducing the Q factor for another notch to equal to or less than a half of the Q factor when the first notch is valid.

4. The sound image localization device of claim 1, wherein the filter performs filtering separately for each of right and left sides of the headphone, the parametric HRTF generator outputs a filter coefficient corresponding to the filtering for each of the right and left sides of the headphone, and when adjustment is made for one of the right and left sides of the headphone in a state in which a notch frequency for the other one of the right and left sides of the headphone is fixed, a range near the fixed notch frequency for the other one of the right and left sides of the headphone is marked in the user adjuster so that a user can recognize the range.

5. A sound image localization device for performing out-of-head sound image localization of sound being listened to by a user through a headphone, the sound image localization device comprising:

a parametric head-related transfer function (HRTF) generator configured to output a filter coefficient for realizing a parametric HRTF based on externally-given frequencies at N notches, N being an integer of 2 or more; and a filter configured to perform, for an input signal, filtering using the filter coefficient output from the parametric HRTF generator and generate an output signal for the headphone, wherein at least one of the parametric HRTF generator and the filter is, when receiving a command to invalidate a first notch of the N notches, capable of realizing a parametric HRTF without the first notch, and if the command is received, the parametric HRTF generator outputs a filter coefficient for reducing a Q factor for another notch as compared to a Q factor when the first notch is valid.

6. A method of performing out-of-head sound image localization of sound being listened to by a user through a headphone, the method comprising steps of:

generating a filter coefficient for realizing a parametric head-related transfer function (HRTF) based on given frequencies at N notches, where N is an integer of 2 or more, and performing, for an input signal, filtering using the filter coefficient and generating an output signal for the headphone, wherein if a first notch of the N notches is invalidated, the method further comprises steps of:

realizing a parametric HRTF without the first notch; and generating a filter coefficient for reducing a Q factor for another notch as compared to a Q factor when the first notch is valid.

7. A non-transitory recording medium storing a program which causes a computer to perform the method of claim 6.

* * * * *